US006082371A

United States Patent [19]

Bader-Saltzman et al.

[11] Patent Number: 6,082,371

[45] Date of Patent: Jul. 4, 2000

[54] HAIR CLIP HAVING A NOVEL GRIPPING MECHANISM AND REMOVABLE DECORATIVE ATTACHMENTS

[75] Inventors: Geraldine Rose Bader-Saltzman, 8 Hyde Park Cir., Denver, Colo. 80209; Rodney Brent McKeever; Ray Louis Hauser, both of Boulder, Colo.

[73] Assignee: Geraldine Rose Bader-Saltzman, Denver, Colo.

[21] Appl. No.: 09/383,546

[22] Filed: Aug. 26, 1999

Related U.S. Application Data

[60] Provisional application No. 60/098,846, Sep. 2, 1998, and provisional application No. 60/129,750, Apr. 16, 1999.

[51] Int. Cl.[7] ..... A45D 8/04; A45D 8/12; A45D 8/00

[52] U.S. Cl. ..... 132/276; 132/275; 132/273

[58] Field of Search ..... 132/275, 276, 132/273, 277, 278, 219, 126, 112

[56] References Cited

U.S. PATENT DOCUMENTS

| | | | |
|---|---|---|---|
| 3,818,917 | 6/1974 | Hudson | 132/112 |
| 4,057,901 | 11/1977 | Bloem | 132/112 |
| 5,343,880 | 9/1994 | McKay | 132/116 |
| 5,881,739 | 3/1999 | Walker et al. | 132/224 |
| 5,937,865 | 8/1999 | Dhaliwal | 132/114 |

*Primary Examiner*—John J. Wilson
*Assistant Examiner*—Robyn Kieu Doan
*Attorney, Agent, or Firm*—Jennifer L. Bales; Macheledt Bales & Johnson LLP

[57] ABSTRACT

A hair clip includes a low profile clip mechanism which translates linear pressure on the ends of the clip into rotational action for opening the curved comb moldings. Springs cause the clip to close when pressure on the clip ends is removed. The barrel of the clip may comprise sections which are fixed with respect to the clip ends and sections which are attached to the comb moldings, and which are rotated by the clip mechanism. Or, the barrel may comprise alternating sections attached to each comb molding. Removable decorative attachments attach to the fixed portions of the barrel of the clip, via magnets, snap on grips, velcro™ or the like.

17 Claims, 5 Drawing Sheets

HAIR CLIP HAVING A NOVEL GRIPPING MECHANISM AND REMOVABLE DECORATIVE ATTACHMENTS

This application claims the benefit of U.S. Patent Application No. 60/098,846, filed Sep. 2, 1998, and U.S. Patent Application No. 60/129,750, filed Apr. 16, 1999.

BACKGROUND OF THE INVENTION

1. Field of the Invention

The present invention relates to hair clips. More particularly, the present invention relates to a hair clip having a novel gripping mechanism and a removable decorative attachment.

2. Description of the Prior Art

Hair clips are presently available on the market having two rows of comb like teeth, or comb moldings, curved toward each other, and tabs extending upward from the clip. When the tabs are squeezed the hair clip opens, moving the comb moldings apart. When the tabs are released, a spring causes the clip to close, bringing the comb moldings together to grip the hair.

This type of hair clip has several disadvantages. First, the tabs extend upward from the clip, meaning that the clip necessarily sticks out from the head rather substantially. Second, the tabs have a defined upwardly extending profile, which results in a certain unavoidable look, and prevents the clip from taking on other appearances.

A need remains in the art for a hair clip having a novel low profile gripping mechanism and a removable decorative attachment.

SUMMARY OF THE INVENTION

The object of the present invention is to provide a hair clip having a novel low profile gripping mechanism and optionally a removable decorative attachment.

The hair clip includes a low profile clip mechanism which translates linear pressure on the ends (or plungers) of the clip into rotational action for opening the curved comb moldings which will grip the hair. Springs cause the clip to close when pressure on the clip ends is removed. The barrel of the clip may comprise sections which are fixed with respect to the clip ends and sections which are attached to the comb moldings, and which are rotated by the clip mechanism. Or, the barrel of the clip may comprise alternating hinged sections which are fixed with respect to each comb molding. Removable decorative attachments attach to the barrel of the clip, via magnets, snap on grips, velcro™ or the like.

The low profile gripping mechanism translates linear motion by the ends of the clip into rotational action for opening the curved comb moldings. In a first embodiment, the inner clip barrel portions attached to the comb moldings have slots at either end, one slot formed in the interior of each barrel section. Push button assemblies at the ends of the clip include tabs inserted into each end of the barrel. At the end of each tab is a helical portion which is inserted into the slots. When the buttons are pushed, the helical portions move inward linearly, causing the slots to rotate about the helical portions. This causes the comb moldings to rotate open with respect to each other.

A second embodiment of the clip mechanism includes assemblies having solid cylindrical extensions with threaded indentations at the ends. The threaded ends of the extensions extend into the inner barrel sections attached to the comb moldings. These barrel sections have threaded protrusions which match the threaded indentations on the extension ends. When the buttons are pushed, the extension ends extend linearly into the barrel ends, forcing the comb moldings barrel sections which form the threaded protrusions to rotate with respect to each other, in order for the threaded protrusions on the barrel to stay aligned with the threaded indentations on the push button assembly extension ends.

A third embodiment of the clip mechanism includes assemblies having solid cylindrical plunger extensions with helical planes and threaded indentations at the overlapping extensions forming an axis for the cylindrical hinge sections attached to the comb moldings. The two hinge sections each has a cam which matches the helical plane on the plungers. When the buttons are pushed, the plungers move linearly into the hinge, forcing the comb moldings to rotate with respect to each other. The cams on the hinge barrel follow the helical planes on the plunger assemblies.

The hair clips may further include removable decorative attachments. The attachments may be removably affixed to the barrel by means of magnets, clips, velcro™ or equivalent attachments means.

DETAILED DESCRIPTION OF THE PREFERRED EMBODIMENT

Figure 3:
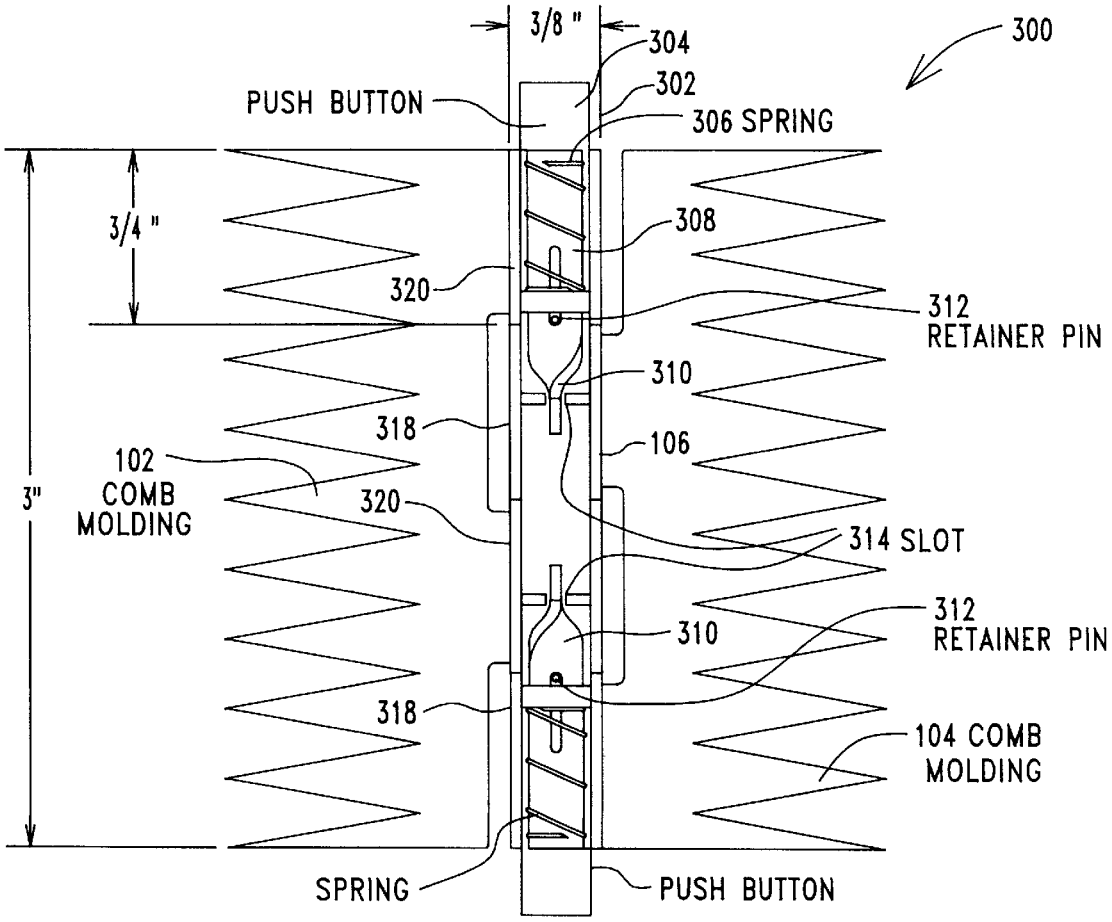
FIG. 3 shows a top section view of a hair clip of FIG. 1 utilizing a first embodiment of a gripping mechanism.
Figure 4:
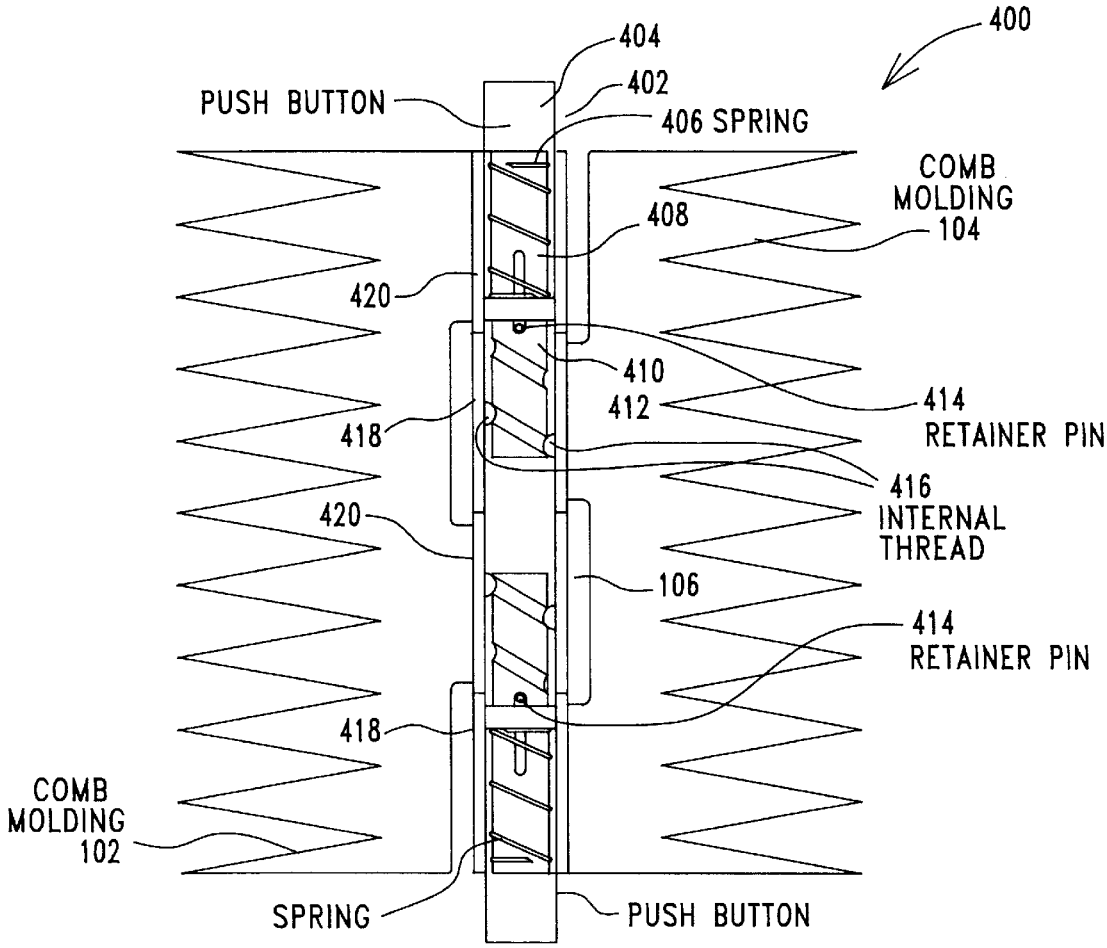
FIG. 4 shows a top section view of a hair clip of FIG. 1 utilizing a second embodiment of a gripping mechanism.
Figure 5:
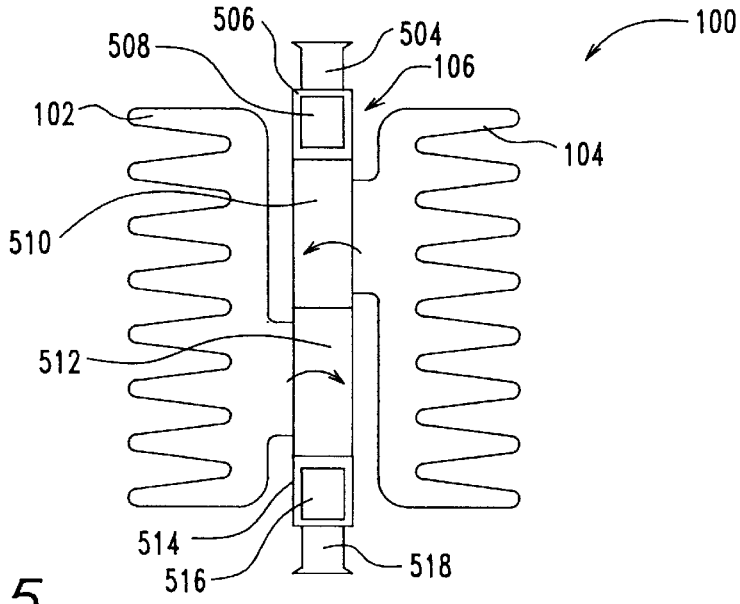
FIG. 5 shows a top plan view of a third embodiment of the hair clip of FIG. 1.

The hair clip embodiments described herein each include a low profile clip mechanism which translates linear motion caused by pressure on the ends of the clip into rotational action which opens the curved combs which will grip the hair. Springs cause the clip to close when pressure on the clip ends is removed. The barrel of the clip may comprise alternating sections which are fixed with respect to each comb molding, and which are rotated by the clip mechanism (as shown in FIGS. 3 and 4). Or, the barrel of the clip may comprise sections which are fixed with respect to the clip ends and sections which are attached to the comb moldings, and which are rotated by the clip mechanism (as shown in FIG. 5). Removable decorative attachments attach to the fixed portions of the barrel of the clip or to the ends of the plungers.

Figure 1:
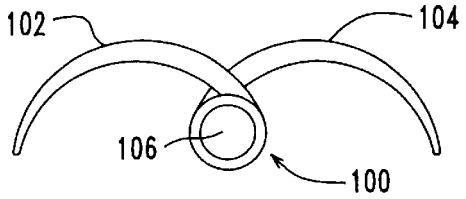
FIG. 1 shows an end view of a hair clip according to the present invention in the open configuration.

FIG. 1 shows an end view of a hair clip 100 according to the present invention, in the open configuration. Comb moldings 102 and 104 are rotated apart by a clip mechanism such as those shown in FIGS. 3 through 5.

Figure 2:
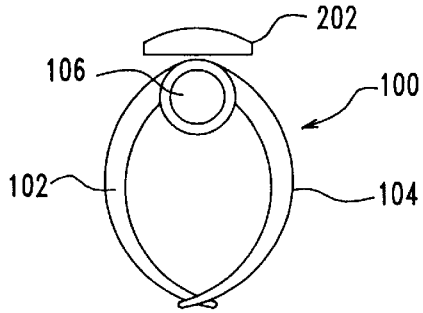
FIG. 2 shows an end view of the hair clip of FIG. 1 in the closed configuration.

FIG. 2 shows an end view of hair clip 100 in the closed configuration. Removable decorative attachment 202 is affixed to barrel 106 as shown in FIG. 5. Attachment 202 may be removably affixed to the barrel by means of magnets, clips, velcro™ or equivalent attachment means.

FIG. 3 shows a top section view of a first embodiment 300 of hair clip 100, utilizing a first embodiment of a gripping mechanism assembly 302. The low profile gripping mechanism (or button assembly) 302 translates linear inward pressure on ends 304 of clip 300 into rotational action for opening curved comb moldings 102, 104. Comb molding 102 is attached to sections 320 of barrel 106, which rotate along with molding 102. Similarly, comb molding 104 is attached to sections 318 of barrel 106, which rotate along with molding 104.

The inner comb sections 318, 320 of barrel 106 have slots 314 formed in the interior of barrel sections 318, one slot formed at the outward end of each section 318, 320. Grip mechanism assemblies 302 at the ends of clip 100 include tabs 308 inserted into each end of barrel 106. At the end of each tab 308 is a helical end 310 which is inserted into slots 314. When buttons 304 are pushed, helical portions 310 extend linearly into slots 314, causing slots 314 to rotate, and thus inner sections 318, 320 and attached comb moldings 102, 104 to rotate open with respect to each other. Outer sections 318, 320 also rotate along with comb moldings 104, 102 respectively.

When the force on buttons 304 is removed, springs 306 force tabs 308 outward, pulling helical portions 310 outward through slots 314. This causes comb moldings 102, 104 to rotate toward each other to the closed position.

Retainer pins 312 retain button assemblies 302 to outer barrel sections 318, 320. Barrel 106 operates very much like a hinge, with alternating sections rotating with respect to each other, and button assemblies 302 acting like hinge pins.

FIG. 4 shows a top section view of a second embodiment 400 of hair clip 100 utilizing a second embodiment of a gripping mechanism assembly 402. The low profile gripping mechanism 402 translates linear inward pressure on ends 404 of clip 400 into rotational action for opening curved comb moldings 102, 104. Comb moldings 102, 104 are attached to sections 418 of barrel 106, which rotate. Barrel 106 is shown in more detail in FIG. 5.

Second embodiment 402 of the grip mechanism includes solid cylindrical extensions 408. At the end of extensions 408 are inward threaded portions 410 having threaded indentations 412. Extensions 408 are inserted into the ends of barrel 106, and threaded portions 410 extend into inner comb molding sections 418, 420 of the barrel. Inner barrel sections 418, 420 have outward extending threads 416, which align with and couple with threaded indentations 412.

When buttons 404 are pushed, extension ends 410 extend linearly into inner barrel section 418, 420 ends, and threaded indentations 412 move linearly inward past protruding threads 416 formed on the interior of barrel sections 418, 420, attached to comb moldings 104, 102. This forces comb moldings 104, 102 to rotate open with respect to each other, in order for the threaded protrusions 416 on inner barrel sections 418, 420 to stay aligned with the threaded indentations 412 on grip assembly extension ends 410. Outer sections 418, 420 are attached to comb moldings 104, 102, respectively, and rotate along with them.

When the force on buttons 404 is removed, springs 406 force extensions 408 outward, pulling threaded ends 410 outward past protruding threads 416. This causes comb moldings 102, 104 to rotate toward each other to the closed position.

Retainer pins 414 retain button assemblies 402 to barrel 106, as described above with respect to FIG. 3.

FIG. 5 shows a top plan view of a third embodiment of hair clip 100. Barrel 106 is formed of four sections 506, 510, 512, and 514. Sections 506 and 514 do not rotate with respect to each other or ends 504, 518, and thus can be considered rotationally fixed. Section 510 is attached, preferably integrally formed, with comb molding 104, and thus when barrel section 510 rotates with respect to ends 504, 518, comb molding 104 rotates as well. Similarly, section 512 is integrally formed with comb molding 102, and thus when barrel section 512 rotates with respect to ends 504, 518, comb molding 102 rotates too. Sections 510, 512 are rotated by grip mechanisms such as those shown in FIGS. 3 and 4.

Decorative element 202 is removably attached to fixed barrel portions 506, 514. For example, elements 508, 516 may comprise magnets which form a magnetic bond with magnets attached to decorative element 202 (not shown). As a second example, elements 508, 516 may comprise velcro™ pads which stick to matching velcro pads attached to decorative element 202 (not shown). Alternatively, decorative element 202 may include snap on clips (not shown) which snap onto barrel sections 506, 514.

Note that in the embodiments of FIGS. 3 and 4, no portion of barrel 106 is rotationally fixed, so that removable decoration 202 must be affixed after clip 100 is in place in the wearers hair.

Figure 6:
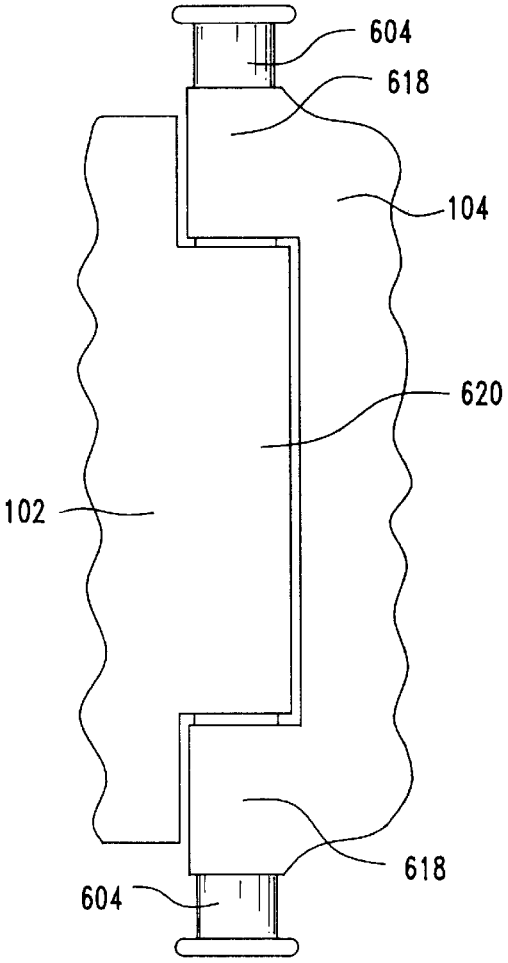
FIG. 6 shows a top plan view of a fourth embodiment of the hair clip of FIG. 1 in the closed position.

FIG. 6 shows a top plan view of a fourth embodiment of hair clip 100 of FIG. 1, in the closed position. As in the case of the other embodiments, linear motion of plungers 604 is translated into rotational motion of combs 102, 104. As plungers 604 are pressed towards each other, combs 102, 104 open, and as plungers 604 move back apart, combs 102, 104 close.

Figure 7A:
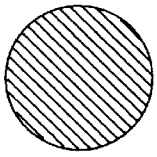
FIG. 7 shows a top plan view of one of the plungers from the embodiment of FIG. 6.
Figure 7B:
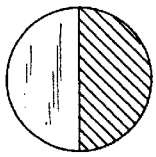
Figure 7C:
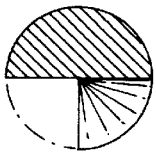
Figure 7D:
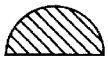
Figure 7:
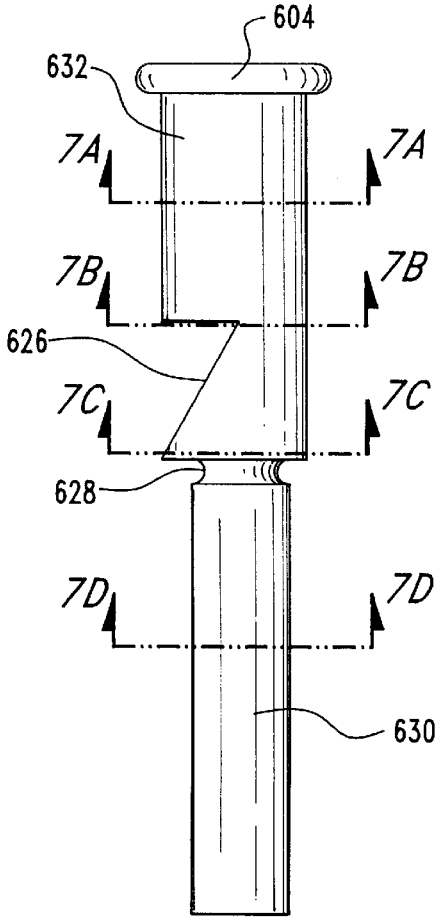

FIG. 7 shows a top plan view of one of plungers 604 from the embodiment of FIG. 6. Each plunger 604 comprises an outer portion 632 having a circular cross section A—A (looking at the end), a helical quarter turn slope having a cross section B—B at the top and cross section C—C at the bottom, a notch 628, and a sliding portion 630.

Figure 8:
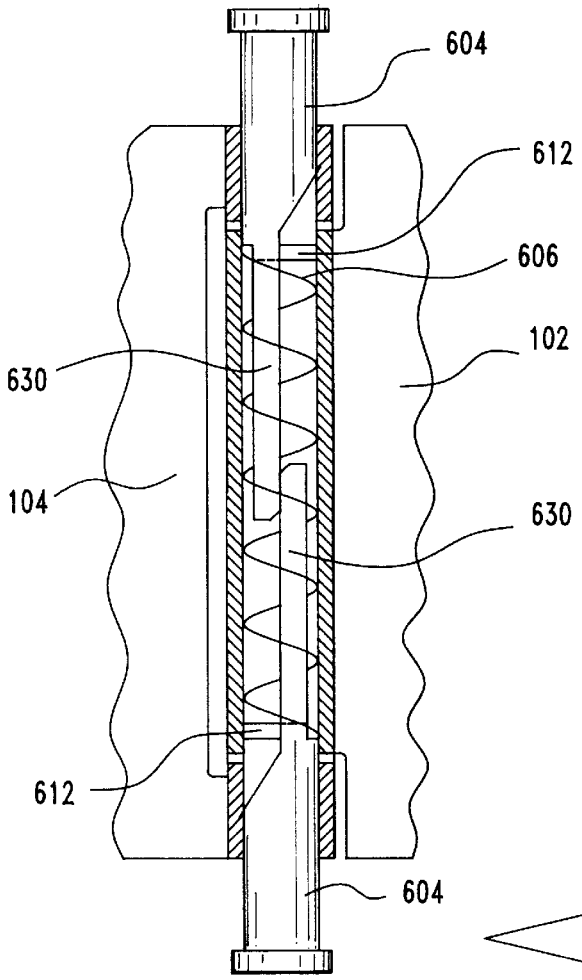
FIG. 8 shows a top section view of the embodiment of FIG. 6 in the closed position.
Figure 9:
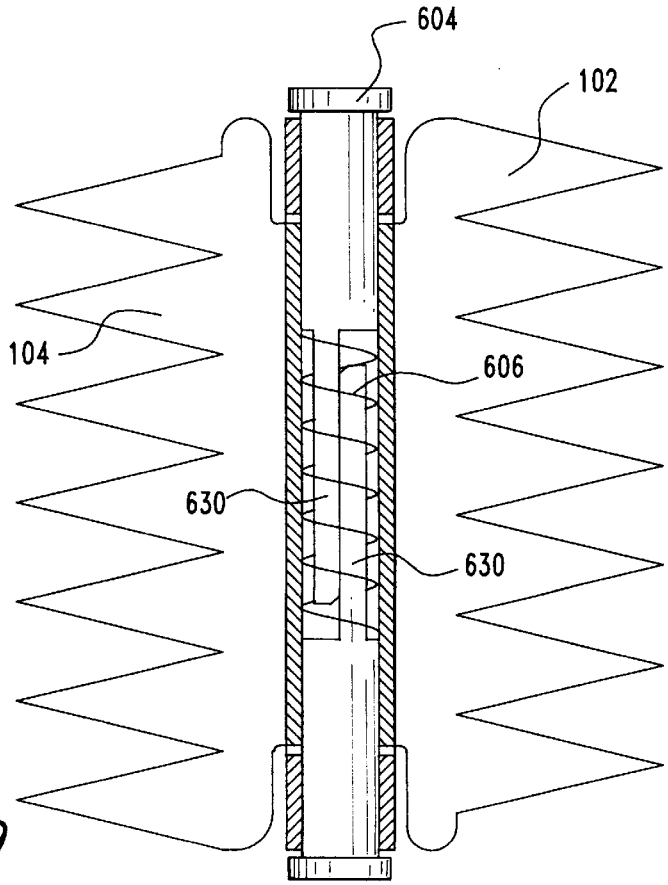
FIG. 9 shows a top section view of the embodiment of FIG. 6 in the open position.
Figure 10A:
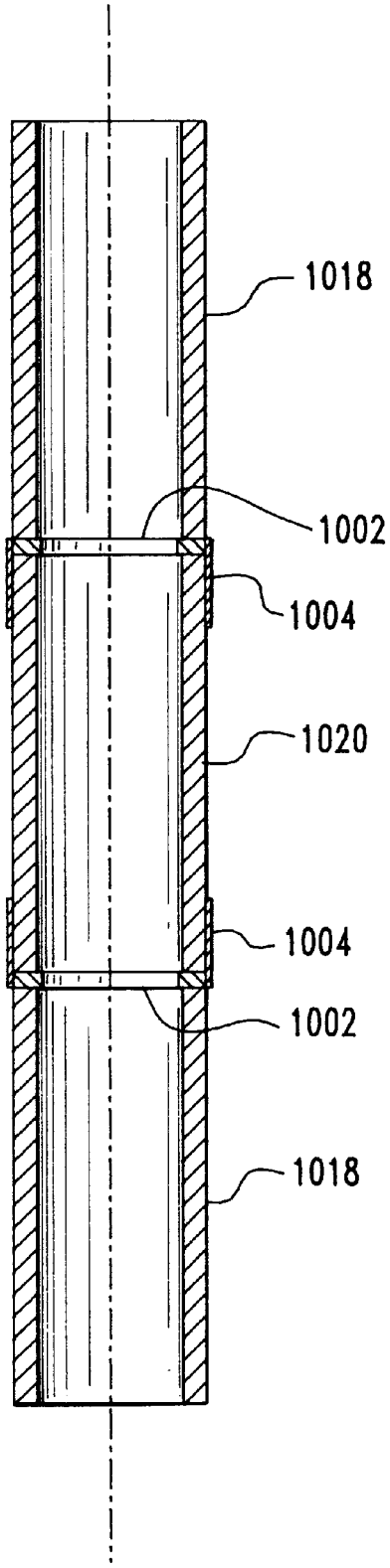
FIG. 10 shows a top view of a mechanism for magnetically attaching decorative attachments to the hair clip of FIG. 1.
Figure 10B:
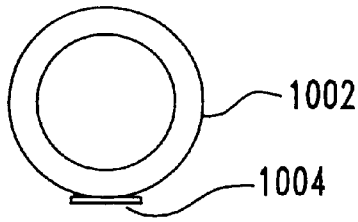
Figure 10C:
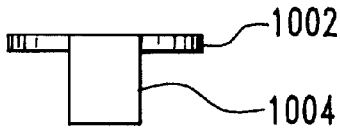
Figure 10D:
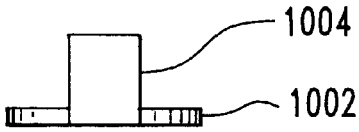

FIG. 8 shows a top section view of the embodiment of FIG. 6 in the closed position. FIG. 9 shows a top section view of the embodiment of FIG. 6 in the open position. Plungers 604 are held apart by spring 606 whose ends anchor at plunger notches 628. As plungers 604 are pushed together, cams 612 cause barrel sections 618, 620 to rotate, rotating combs 102, 104 apart. This occurs because cams 612 are rotated by helical slopes 626. Half round sliding portions 630 slide past each other and prevent the plungers from rotating. When combs 102, 104 are in the closed position, they can be held closed by snapping clips onto the protruding portions of plungers 604. This prevents plungers 604 from moving together, and thus prevents the combs from opening.

FIG. 10 shows a top view of a mechanism for magnetically attaching decorative attachments to the hair clip of FIG. 1. Washers 1002 are inserted between barrel sections 1018 and 1020. Washers 1002 have protruding tabs 1004 which are bent parallel to the barrel sections. Magnets attached to decorative attachments then affix to tabs 1004. Tabs 1004 are ferromagnetic or may be permanently magnetized.

Hair clip 100 is generally around three inches long and has a barrel inside diameter of about ⅜ inch. Each section of the barrel is thus about ¾ inch. Preferably all of the parts of hair clip 100 are formed of molded plastic, except the springs and the retaining pins, which are formed of a metal such as stainless steel.

While the exemplary preferred embodiments of the present invention are described herein with particularity, those skilled in the art will appreciate various changes, additions, and applications other than those specifically mentioned, which are within the spirit of this invention. For example, other methods of translating linear motion into rotational motion may be used in the clip mechanism, and other methods of removably affixing the decorative attachments may be used.

What is claimed is:

1. A low profile hair clip comprising:

a first elongated comb having a plurality of teeth;

a second elongated comb having a plurality of teeth, the second comb rotatably attached to the first comb along a common axis, such that the first comb and the second comb can rotate to a closed position wherein the teeth of the first comb engage and alternate with the teeth of the second comb, and the first comb and the second comb can rotate to an open position, wherein the teeth of the first comb disengage from the teeth of the second comb;

a first plunger located at one end of the hair clip and positioned to move linearly along the common axis, the first plunger coupled with the first comb such that linear inward movement of the plunger translates to rotational motion of the first comb into the open position;

a second plunger located at the other end of the hair clip and positioned to move linearly along the common axis, the second plunger coupled with the second comb such that linear inward movement of the plunger translates to rotational motion of the second comb into the open position; and a bias element for biasing the first comb and the second comb into the closed position.

2. The hair clip of claim 1, further including barrel sections disposed between the plungers and along the common axis, at least one of the barrel sections engaged with each of the combs, such that at least some of the barrel sections rotate with respect to each other as the combs rotate with respect to each other.

3. The hair clip of claim 2, wherein barrel sections adjacent to the plungers each include an internal surface defining a slot disposed perpendicular to the common axis, and wherein each plunger includes a helical portion engaged with the respective slot to turn the slot as the helical portion moves linearly, such that the barrel sections adjacent to the plungers rotate with respect to each other.

4. The hair clip of claim 2, wherein barrel sections adjacent to the plungers each include threaded protrusions and wherein the plungers include threaded indentations engaged with the threaded protrusions such that the barrel sections adjacent to the plungers rotate with respect to each other as the threaded indentations move linearly.

5. The hair clip of claim 2, wherein barrel sections adjacent to the plungers each include an internal surface defining a semicircular aperture, and wherein the plungers each include an inward extending portion having a helical quarter turn slope and having a semicircular cross section engaged with the respective aperture, such that the barrel sections adjacent to the plungers rotate with respect to each other as the inward extending portions move linearly.

6. The hair clip of claim 2, wherein each comb is integrally formed with at least one barrel section.

7. The hair clip of claim 2, further comprising:

a decorative attachment; and means for detachably attaching the decorative attachment to at least one barrel section.

8. The hair slip of claim 7, wherein the means for attaching comprises an attachment magnet affixed to the decorative attachment and at least one barrel magnet attached to a barrel section.

9. The hair clip of claim 7, wherein the barrel magnet comprises at least one washer disposed between two barrel sections and having a tab aligned parallel to the common axis.

10. The hair slip of claim 7, wherein the means for attaching comprises a magnet affixed to the decorative attachment and a ferromagnetic portion attached to at least one barrel section.

11. The hair clip of claim 10, wherein the ferromagnetic portion comprises at least one washer disposed between two barrel sections and having a tab aligned parallel to the common axis.

12. The hair slip of claim 7, wherein the means for attaching comprises a piece of velcro™ affixed to the decorative attachment and a reciprocal piece of velcro™ attached to at least one barrel section.

13. The hair clip of claim 2, wherein at least two of the barrel sections are fixed barrel sections, which do not rotate with respect to each other or to either of the plungers.

14. The hair clip of claim 13, further comprising:

a decorative attachment; and means for detachably attaching the decorative attachment to the fixed barrel sections.

15. The hair clip of claim 2, wherein the teeth of the first comb curve towards the teeth of the second comb, and the teeth of the second comb curve towards the teeth of the first comb.

16. The hair clip of claim 1, wherein the teeth of the first comb curve towards the teeth of the second comb, and the teeth of the second comb curve towards the teeth of the first comb.

17. The hair clip of claim 1, further including:

a decorative attachment; and means for detachably attaching the decorative attachment to the hair clip.

* * * * *